US005915235A

United States Patent [19]

DeJaco et al.

[11] Patent Number: 5,915,235

[45] Date of Patent: Jun. 22, 1999

[54] ADAPTIVE EQUALIZER PREPROCESSOR FOR MOBILE TELEPHONE SPEECH CODER TO MODIFY NONIDEAL FREQUENCY RESPONSE OF ACOUSTIC TRANSDUCER

[76] Inventors: Andrew P. DeJaco, 10424 Flanders Cove, San Diego, Calif. 92126; John A. Miller, 4178 Decoro St., #39, San Diego, Calif. 92122

[21] Appl. No.: 08/953,102

[22] Filed: Oct. 17, 1997

Related U.S. Application Data

[63] Continuation of application No. 08/456,277, Apr. 28, 1995.

[51] Int. Cl.[6] ..... G10L 3/02

[52] U.S. Cl. ..... 704/234; 704/203

[58] Field of Search ..... 704/219, 228, 704/234, 203; 375/232; 342/90

[56] References Cited

U.S. PATENT DOCUMENTS

| | | | |
|---|---|---|---|
| 3,509,280 | 4/1970 | Jones | 395/2.42 |
| 3,668,702 | 6/1972 | Jones | 342/91 |
| 4,790,016 | 12/1988 | Mazor et al. | 704/203 |
| 4,914,701 | 4/1990 | Zibman | 704/203 |
| 5,031,195 | 7/1991 | Chevillat et al. | 375/234 |
| 5,235,671 | 8/1993 | Mazor | 704/200 |
| 5,267,266 | 11/1993 | Chen | 375/232 |
| 5,646,961 | 7/1997 | Shoham et al. | 375/243 |

FOREIGN PATENT DOCUMENTS

| | | | |
|---|---|---|---|
| 674415 A1 | 9/1995 | European Pat. Off. | H04M 1/00 |
| 767570 A2 | 4/1997 | European Pat. Off. | H03H 21/00 |
| 401123554 | 5/1989 | Japan | H04M 1/00 |
| 406030090 | 2/1994 | Japan | H04M 1/00 |

OTHER PUBLICATIONS

Lawrence R. Rabiner and Ronald W. Schafer, Digital Processing of Speech Signals, Prentice–Hall, pp. 396–399, 1978.

Leon W. Couch II, Digital and Analog Communication Systems, Macmillan, pp. 183–186, and 579, 1993.

*Primary Examiner*—David R. Hudspeth
*Assistant Examiner*—Tālivaldis Ivars Šmits
*Attorney, Agent, or Firm*—Russell B. Miller; Linli L. Golden; Thomas R. Rouse

[57] ABSTRACT

The present invention teaches an equalizer preprocessor for a mobile telephone speech coder that adapts to the characteristics of its input transducer. The equalizer determines the frequency response of the input transducer by measuring the long term characteristics of the input signal and estimating the spectral envelope of that signal. The equalizer then adapts so that the output signal has a spectral response closer to a perceptually ideal response in accordance with the calculated spectral envelope. In a first embodiment of the present invention, the adaptive equalizer is implemented using digital filtering techniques. The equalizer determines a set of long term autocorrelation coefficient values and from these values generates a set of filter taps which serve to whiten or flatten the spectral response of the input signal. This whitened signal is then passed through a target filter which impresses upon the whitened signal the target spectral response. In an alternative embodiment, the equalizer is realized by using a bank of variable gain control elements to adjust the energy of subbands of the input signal. A subband filter bank divides the input signal into frequency subbands. Each of the subbands is then provided to a corresponding variable gain stage element and the energy of the subband is amplified or reduced depending upon a corresponding subband gain signals. The subband gain signals are determined in accordance with the long term subband energy and a target subband energy.

21 Claims, 2 Drawing Sheets

ADAPTIVE EQUALIZER PREPROCESSOR FOR MOBILE TELEPHONE SPEECH CODER TO MODIFY NONIDEAL FREQUENCY RESPONSE OF ACOUSTIC TRANSDUCER

This is a Continuation of application Ser. No. 08/456,277, filed Apr. 28, 1995.

BACKGROUND OF THE INVENTION

I. Field of the Invention

The present invention relates to communications. More particularly, the present invention relates to a novel and improved method and apparatus for equalization in a speech communication system.

II. Description of the Related Art

Transmission of voice by digital techniques has become widespread, particularly in long distance and digital radio telephone applications. This in turn has created interest in determining methods which minimize the amount of information sent over the transmission channel while maintaining high quality in the reconstructed speech. If speech is transmitted by simply sampling and digitizing, a data rate on the order of 64 kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices which employ techniques to compress voiced speech by extracting parameters that relate to a model of human speech generation are typically called vocoders. Such devices are composed of an encoder, which analyzes the incoming speech to extract the relevant parameters, and a decoder, which resynthesizes the speech using the parameters which it receives over the transmission channel. The model is constantly changing to accurately model the time varying speech signal. Thus, the speech is divided into blocks of time, or analysis frames, during which the parameters are calculated. The parameters are then updated for each new frame.

Of the various classes of speech coders, the Code Excited Linear Predictive Coding (CELP), Stochastic Coding, or Vector Excited Speech Coding coders are of one class. An example of a coding algorithm of this particular class is described in the paper "A 4.8 kbps Code Excited Linear Predictive Coder" by Thomas E. Tremain et al., *Proceedings of the Mobile Satellite Conference,* 1988. Similarly, examples of other vocoders of this type are detailed in U.S. Pat. No. 5,414,796, entitled "Variable Rate Vocoder", which is assigned to the assignee of the present invention and incorporated by reference herein.

In the transmission of speech signals, the perceptual quality is of primary importance to users and service providers. Extensive studies have been conducted to determine what the most perceptually pleasing spectral response is to listeners. In response to these studies, systems have been developed that uniformly boost the bass response and reduce down the high end response of the speaker. The usefulness of such systems, however, is premised on a uniform input source. In systems where there is variety of possible input sources each with a unique spectral response characteristic, there is a need for spectral equalization that takes into account the effects of different input sources.

SUMMARY OF THE INVENTION

The present invention is a novel and improved equalizer that adapts to the characteristics of the input source. The equalizer determines the spectral response of the input source by measuring the long term characteristics of the input signal and estimating the spectral envelope of that signal. The equalizer of the present invention then adapts so that the output signal has a spectral response closer to ideal in accordance with the estimated spectral response of the input source.

In a first embodiment of the present invention, the adaptive equalizer is implemented using digital filtering techniques. The equalizer determines a set of long term autocorrelation coefficient values. From these values the equalizer generates a set of filter taps which serve to whiten or flatten the spectral response of the input signal. This whitened signal is then passed through a target filter which impresses upon the whitened signal the target spectral response.

In an alternative embodiment, the equalizer is realized by means of a bank of variable gain control elements used to adjust the energy of frequency subbands of the input signal. A subband frequency filter bank divides the input signal into subbands. Each of the subbands is then provided to a corresponding variable gain stage element and the energy of the subband is amplified or reduced depending upon corresponding subband gain signals. The subband gain signals are determined in accordance with the long term subband energy and a target subband energy.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
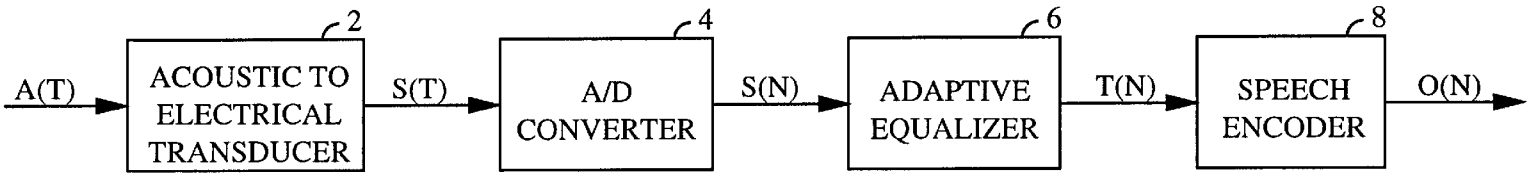
FIG. 1 is a block diagram of an exemplary implementation of the present invention.

FIG. 1 illustrates an exemplary implementation of the present invention. It should be noted that all of the elements illustrated in FIG. 1 may be collocated at an element in a communication system or may be distributed among various elements in the communication system. For example, all of the elements in FIG. 1 may be located in a handset or some of the elements may be provided in the handset while others reside in a central communications center, such as a public switching telephone network (PSTN) or a base station.

The acoustic signal, a(t), is provided to acoustic to electrical transducer 2. Acoustic to electrical transducer 2 converts the acoustic signal to an electrical signal s(t). Acoustic to electrical transducer 2 may be a microphone such as is used in hands free mobile operation or it may be a handset input, each of which has a different frequency response and each of which will provide a different level of perceptual quality.

Figure 2A:
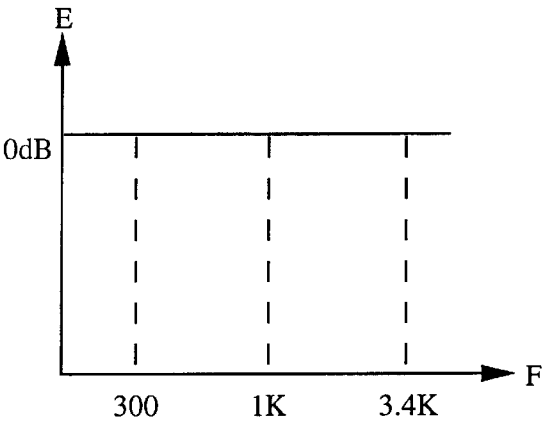
FIGS. 2A–2C are illustrations of the spectral response curves of input speech depending upon the type of acoustic to electrical transducer.
Figure 2B:
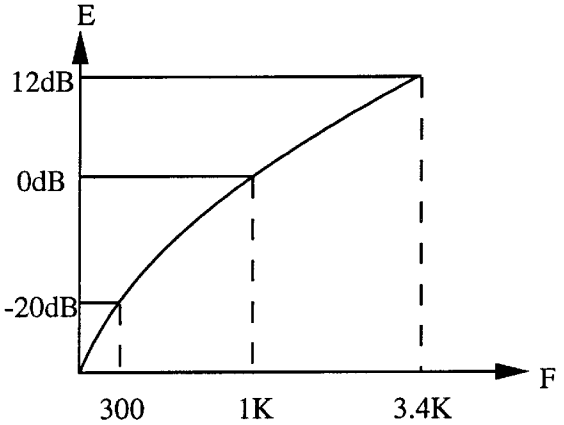
Figure 2C:
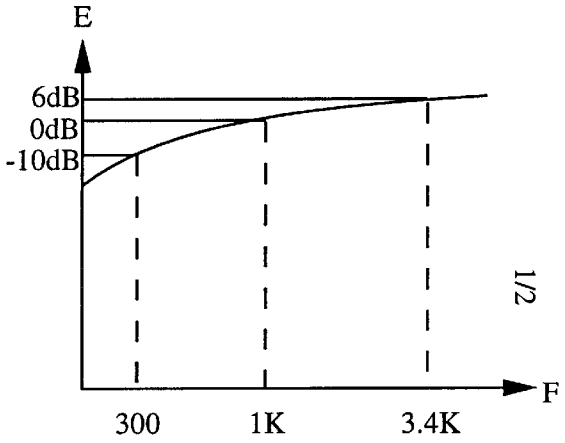

Referring to FIGS. 2A–2C, FIGS. 2A and 2B illustrate two possible frequency response curves for acoustic to electrical transducer 2. FIG. 2A illustrates the spectral response for a typical flat microphone input response. The flat microphone input overemphasizes the low frequencies while failing to amplify the high frequencies of the speech for better intelligibility. FIG. 2B illustrates the spectral response for what is commonly referred to as a tinny handset. This response overly attenuates the low frequency components of the speech signal and over emphasizes the high frequency components.

FIG. 2C illustrates an ideal spectral response of the analog input signal. The ideal response may be viewed as a combination of the frequency response illustrated in FIG. 2A with the frequency response illustrated in FIG. 2B. In FIG. 2A, the microphone does not adequately attenuate the signal at 300 Hz with a response of 0 dB, whereas in FIG. 2B the pre-emphasizing handset overly attenuates the signal at 300 Hz with a frequency response of −20 dB. The ideal response attenuates the signal at the low end but not as severely as the pre-emphasizing handset does. In the exemplary embodiment, the ideal response, as illustrated in FIG. 2C, has a response of −10 dB at 300 Hz.

At the high end, the microphone does not adequately amplify the signal with a frequency response of 0 dB at 3400 Hz (FIG. 2A), whereas the pre-emphasizing microphone overly amplifies the signal with a frequency response of 12 dB at 3400 Hz (FIG. 2B). An ideal response amplifies the high end components of the speech but not as much as the pre-emphasizing handset. In the exemplary embodiment, the ideal spectral response would have a frequency response of 6 dB at 3400 Hz (FIG. 2C). The objective of the present invention is to operate in conjunction with acoustic to electrical transducer 2 so that the spectral envelope of the signal into speech encoder 8 is the ideal or target response regardless of the spectral response characteristics of the acoustic to electrical transducer 2.

Referring back to FIG. 1, the electrical signal, s(t), is provided by acoustic to electrical transducer 2 to analog to digital converter (A/D CONVERTER) 4. Analog to digital converter 4 samples s(t) and quantizes the samples into digital samples, s(n). The digital samples, s(n), are provided to the present invention, adaptive equalizer 6. Adaptive equalizer 6 examines the long term spectral response of the input signal, s(n), and modifies that spectral response toward the target response illustrated in FIG. 2C. The equalized digital samples, t(n) are then provided by adaptive equalizer 6 to speech encoder 8. In the exemplary embodiment, speech encoder 8 is a variable rate CELP coder as described in the aforementioned U.S. Pat. No. 5,414,796. Speech encoder 8 encodes, and typically compresses, the equalized digital samples and outputs encoded digital samples o(n).

Figure 4:
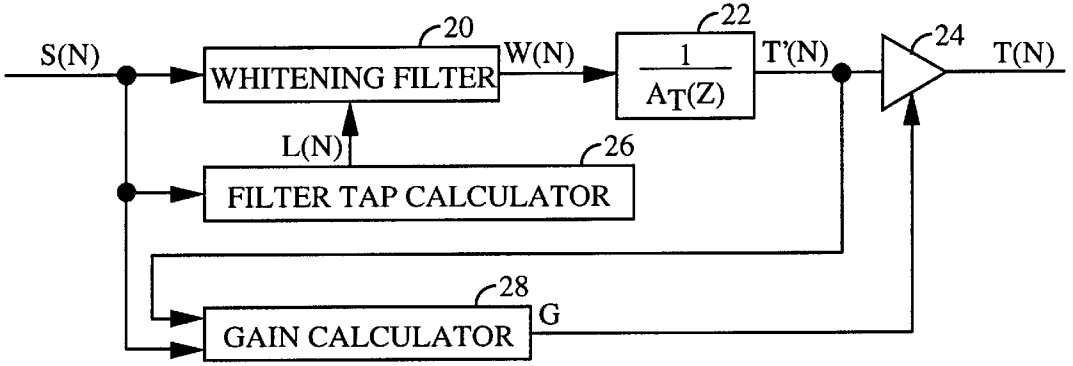
FIG. 4 is a block diagram of the present invention implemented using an adaptive digital filter design.

FIG. 4 illustrates a first exemplary embodiment of the present invention using adaptive filtering for equalization. The digital samples are provided to a whitening filter 20. Whitening filter 20 flattens the long term spectral envelope of the input digital samples, in accordance with coefficients that are generated and provided by filter tap calculator 26. The operation of filter tap calculator 26 is described in detail below. The signal output from whitening filter 20 has a flat spectral envelope and is provided to target filter 22, which impresses the perceptually optimized target spectrum upon the whitened signal. Variable gain amplifier 24 in conjunction with gain calculator 28 are provided so that the energy of the signal out of the equalizer 6 is equal to the energy into the equalizer 6.

The digital samples, s(n), are provided to whitening filter 20. Whitening filter 20 looks at the long term spectral response of the digital samples and over the long term adapts to flatten the spectral response. In the exemplary embodiment, whitening filter 20 is a ten tap linear predictive coefficient (LPC) filter. The flattened spectral response samples, w(n), are then provided to target filter 22. Target filter 22 is a filter with the spectral response that is the target response. The flat spectral response input signal, w(n), then is output from target filter 22 as, t'(n), with the target spectral response. The output of target filter 22 is provided to variable gain stage 24. Variable gain stage 24 is provided so that the energy of the output signal, t(n), is the same as the energy of the input signal, s(n).

The adaptation of filter taps of whitening filter 20 is computed in filter tap calculator 26. In the exemplary embodiment, filter tap calculator 26 determines the long term autocorrelation of the input digital samples, s(n), and from the long term autocorrelation determines a set of filter tap values. The computation of autocorrelation coefficients is well known in the art and is described in detail in the aforementioned U.S. Pat. No. 5,414,796. The long term autocorrelation values ($R_{LTi}(n)$) are computed as:

$$R_{LTi}(n)=\alpha R_{LTi}(n-1)+(1-\alpha)R_i(n), 0<i<L \tag{1}$$

where $$R_i(n)=\sum_{k=0}^{N-1} s(k+n)\cdot s(k+i+n) \qquad N=160 \tag{2}$$

where k is a summation index variable, L is the order of the filter, N is the length of the analysis window, i is the autocorrelation lag, n is frame reference number, and $\alpha$ is a constant related to the time constant of the integration. In the exemplary embodiment, $\alpha$ is 0.995 which corresponds to a time constant of approximately 10 seconds. It should be noted that the long term autocorrelation values should only be updated when speech is present. A method for determining the presence of a speech signal is detailed in the aformentioned U.S. Pat. No. 5,414,796. When no speech is present the long term autocorrelation values remain unchanged.

The long term autocorrelation values $R_{LTi}(n)$ are used to compute the filter tap coefficient values. In the exemplary embodiments the filter and the long term autocorrelation values are converted to filter tap values L(n) by means of Durbin's Recursion which is well known in the art and described in detail in the aforementioned U.S. Pat. No. 5,414,796.

The gain of variable gain stage 24, G, is computed in gain calculator 28. In the exemplary embodiment, the input energy of the input frame $E_{in}(n)$ is determined in accordance with the equation:

$$E_{in}(n)=\alpha E_{in}(n-1)+(1-\alpha)s^2(n), \tag{3}$$

where $\alpha$ is related to the time constant of the integration. In the exemplary embodiment $\alpha$ is 0.995 which corresponds to a time constant of approximately 10 seconds. Similarly, the output energy $E_{out}(n)$ is determined in accordance with the equation:

$$E_{out}(n)=\alpha E_{out}(n-1)+(1-\alpha)t'^2(n), \tag{4}$$

Thus, the gain G is determined by the equation:

$$G = \sqrt{\frac{E_{in}(n)}{Eout(n)}}. \quad (5)$$

During the initialization period of the filtering operation, the spectral response of the whitening filter 20 is set to the inverse response of target filter 22. That is, the input response is set to $A_t(z)$, whereas the target filter response is always $1/A_t(z)$. Therefore, the effects of these two filters offset one another and the effect is that until a predetermined time period elapses the digital sample, s(n), will be the same of as the output samples, t(n). After the predetermined period, which in the exemplary embodiment is 10 seconds, operation of the equalizer proceeds as described above.

One of the advantages of using the adaptive filter implementation of the present invention is that the hardware to realize this implementation is predominantly in place in the implementation of the speech encoder. Hardware to compute autocorrelations and to compute Durbin's recursion exists in the exemplary embodiment of the speech encoder 8. One of the drawbacks of the adaptive filter implementation is that there is a limited amount of spectral correction attainable by this implementation using a manageable number of taps, such as the exemplary number of ten.

Figure 5:
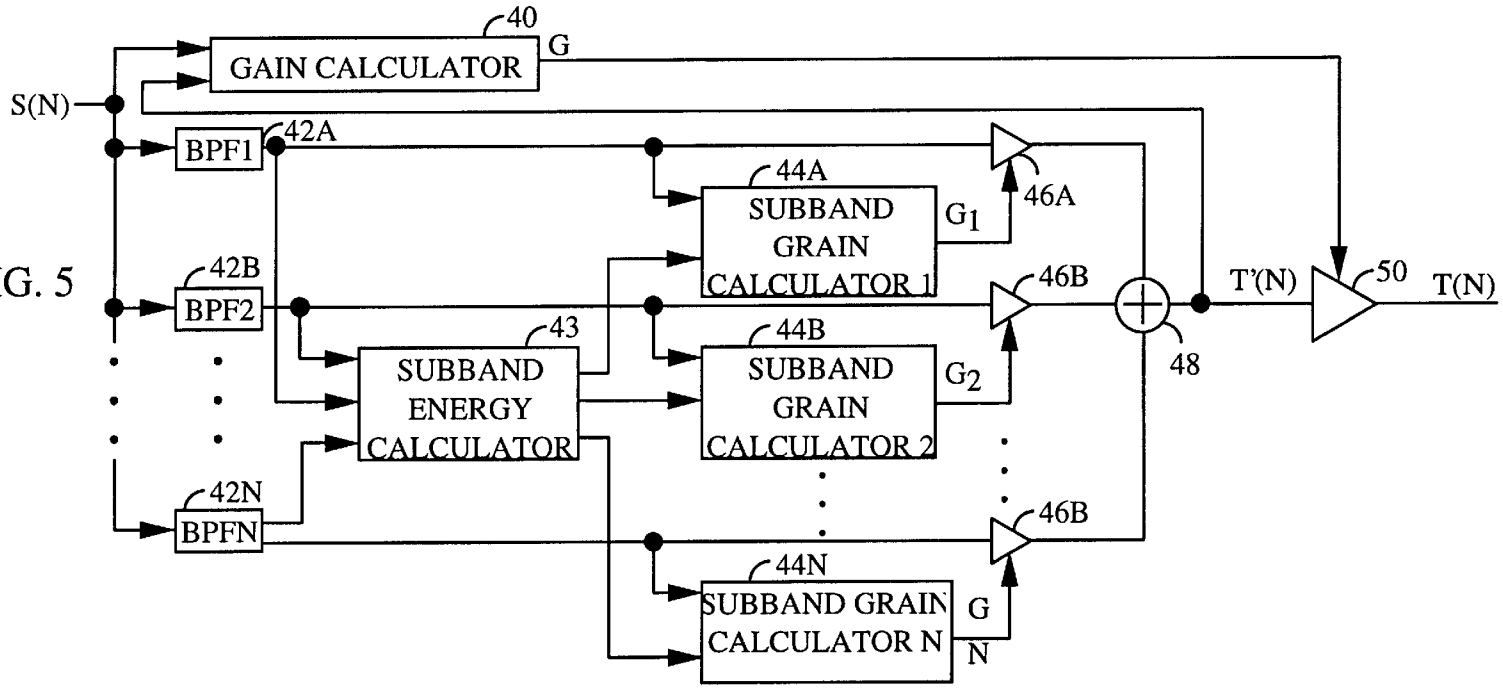
FIG. 5 is a block diagram of the present invention implemented using a bank of adaptive gain elements.

In an alternative embodiment, the equalizer is realized by means of a bank of variable gain control elements used to adjust the energy of frequency subbands of the input signal. Referring to FIG. 5, a subband filter bank 42*a*–42N, divides the input signal into subbands $s_1(n)$–$S_N(n)$. The implementation of subband filters is well known in the art.

Each of the subband signals output by subband filters 42*a*–42N is provided to a corresponding variable gain stage element 46*a*–46N and the energy of the subband signal is amplified or reduced depending upon the corresponding gain signals $G_1$–$G_N$ provided by subband gain calculators 44*a*–44N. The purpose of variable gain stage elements 46*a*–46N is to amplify the respective subbands so as to attain a long term spectral envelope as close as possible to the perceptually optimized target envelope.

Figure 3:
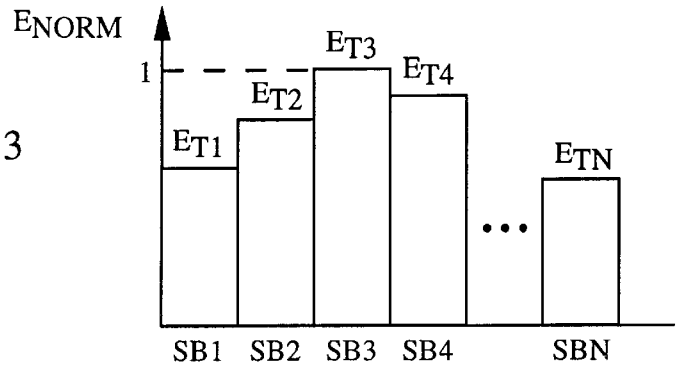
FIG. 3 is an illustration of a normalized target energy curve divided into discrete subbands.

Subband gain calculators 44*a*–44N compute gains $G_1$–$G_N$ in accordance with which the energy of the corresponding subband is amplified. Referring to FIG. 3, the target spectrum is alternatively represented as discrete subbands with each subband denoted SB1, SB2 . . . SBN. Each subband has a corresponding normalized target subband energy denoted $E_{t1}, E_{t2} \ldots E_{tN}$. The long term energy at time n for subband i, $E_i(n)$, is calculated as:

$$E_i(n)=\alpha E_i(n-1)+(1-\alpha)s_i^2(n), \quad (6)$$

where $$E_i(0)=C \bullet E_{ti}, \quad (7)$$

where C is a constant determined in accordance with the acoustic to digital gain of the analog front end comprising acoustic to electrical transducer 2 and analog to digital converter 4, and where $\alpha$ is related to the time constant of the integration and where $s_i(n)$ is the component of the input signal s(n) in subband i. In the exemplary embodiment $\alpha$ is 0.995 which corresponds to a time constant of approximately 10 seconds. The maximum energy of the N subbands is defined as:

$$E_{max}(n)=\max\ (E_i(n) \text{ for } 0<i<N). \quad (8)$$

Subband energy calculator 43, receives the outputs from each of the bandpass filters 42*a*–42N, and computes the energy of the input signal in the subband and then determines the value $E_{max}(n)$ as described above. The calculated value of $E_{max}(n)$ is then provided to each of the subband gain calculators 44*a*–44N. Thus, the subband gain, $G_i$, is determined by the equation:

$$G_i = \sqrt{\frac{E_{ti}}{(E_i(n)/E_{\max}(n))}}, \quad (9)$$

where $E_{ti}$ is the normalized subband target energy as illustrated in FIG. 3.

The amplified subband signals $G_1 \bullet s_1(n)$ through $G_N \bullet s_N(n)$ are provided to summing element 48, which sums the amplified subband signals to provide t'(n) which has approximately the long term target spectrum. Variable gain stage 50 operates in accordance with gain calculator 40 to assure that the long term energy of the output signal, t(n), is the same as the long term energy of the input signal s(n). In the exemplary embodiment, gain calculator 40 generates the overall gain value G as described above in relation to gain calculator 28.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. In a mobile telephone, an apparatus for encoding a speech signal, comprising:

(A) an acoustic to electrical transducer that receives the speech signal and converts the speech signal to an electrical signal, the acoustic to electrical transducer having a frequency response that is different from an ideal frequency response;

(B) an adaptive equalizer that receives an input signal representative of the electrical signal from the acoustic to electrical transducer, the adaptive equalizer including:

first subband filter means for receiving said input signal and for bandpass filtering said input signal in accordance with a first bandpass frequency format to output a first subband signal;

first variable gain means for receiving said first subband signal and for amplifying said first subband signal in accordance with a first subband target gain to output a first gain adjusted subband signal;

at least one additional subband filter means for receiving said input signal and for bandpass filtering said input signal in accordance with at least one additional bandpass frequency format to output at least one additional subband signal;

at least one additional variable gain means for receiving said at least one additional subband gain signal and for amplifying said at least one additional subband gain signal in accordance with at least one additional target subband gain to output at least one additional gain adjusted subband signal; and summing means for receiving said first gain adjusted subband signal and said at least one additional gain adjusted subband signal and for summing said gain adjusted signals to provide an equalized signal having a spectrum that is closer to said ideal frequency response;

(C) a speech encoder that encodes the equalized signal from the adaptive equalizer.

2. The apparatus of claim 1 further comprising:

first subband gain calculator means for receiving said first subband signal and computing a long term subband energy in accordance with said first subband signal and for computing said target subband gain value in accordance with said long term subband energy and a first target subband energy; and at least one additional subband gain calculator means for receiving said at least one additional subband signal and computing at least one additional long term subband energy in accordance with said at least one additional subband signal and for computing at least one additional target subband gain value in accordance with said long term subband energy and a at least one additional target subband energy.

3. The apparatus of claim 2, further comprising:

subband energy calculator means for receiving said subband signals, measuring the energy of said subband signals, and determining a maximum energy of said subband signals, wherein said subband gain calculator means compute said target subband gain values further in accordance with said maximum energy.

4. The apparatus of claim 1, further comprising:

gain means for determining a gain factor for adjusting the energy of said equalized signal to generate a gain adjusted output signal which has the same long term energy level as said input signal.

5. The apparatus of claim 4 wherein said gain factor is based on a ratio of the energy of said input signal and the energy of said equalized signal.

6. In a mobile telephone, an apparatus for encoding a speech signal, comprising:

(A) an acoustic to electrical transducer that receives the speech signal and converts the speech signal to an electrical signal, the acoustic to electrical transducer having a frequency response that is different from an ideal frequency response;

(B) an adaptive equalizer that receives an input signal representative of the electrical signal from the acoustic to electrical transducer, the adaptive equalizer including:

adaptive whitening filter means for receiving said input signal and for filtering said input signal in order to flatten a long term spectral response of said input signal to provide a whitened signal; and target filter means for receiving said whitened signal and for filtering said whitened signal in accordance with a target spectral response to provide a target filtered signal, wherein said target spectral response is for impressing a spectrum that is closer to said ideal frequency response upon said whitened signal;

(C) a speech encoder that encodes the target filtered signal from the adaptive equalizer.

7. The adaptive equalizer of claim 6, further comprising:

input spectral response means for receiving said input signal and for computing said long term spectral response in accordance with said input signal.

8. The adaptive equalizer of claim 7, further comprising:

filter tap calculator means for generating filter coefficient values for said adaptive whitening filter responsive to said input signal.

9. The adaptive equalizer of claim 8 wherein said filter tap calculator means generates said filter coefficient values in accordance with a linear prediction coding (LPC) format.

10. The adaptive equalizer of claim 9 wherein said filter tap calculator means generates said filter coefficient values in accordance with long term autocorrelation coefficients.

11. The adaptive equalizer of claim 7, further comprising:

gain calculator means for determining a gain factor for adjusting the energy of said target filtered signal so that an output equalized signal has the same long term energy level as said input signal; and variable gain stage means for imposing said gain factor upon said target filtered signal to provide said output equalized signal.

12. The adaptive equalizer of claim 11 wherein said gain factor is based on a ratio of the long term energy of said input signal and the long term energy of said target filtered signal.

13. In a mobile telephone, a method for encoding a speech signal using adaptive equalization, comprising the steps of:

providing the speech signal to an acoustic to electrical transducer that converts the speech signal to an electrical signal, the acoustic to electrical transducer having a frequency response that is different from an ideal frequency response;

filtering an input signal representative of the electrical signal from the acoustic to electrical transducer in order to flatten a long term spectral response of said input signal to provide a whitened signal;

filtering said whitened signal in accordance with a target spectral response to provide a target filtered signal, wherein said target spectral response impresses a spectrum that is closer to said ideal frequency response upon said whitened signal;

(C) encoding, with a speech encoder, the target filtered signal from the adaptive equalizer.

14. The method of claim 13, further comprising the step of:

determining said long term spectral response in accordance with said input signal.

15. The method of claim 14, further comprising the step of:

generating filter coefficient values responsive to said input signal for filtering said input signal to provide said whitened signal.

16. The method of claim 15 wherein said step of generating filter coefficient values generates said filter coefficient values in accordance with a linear prediction coding (LPC) format.

17. The method of claim 15 wherein said step of generating filter coefficient values generates said filter coefficient values in accordance with long term autocorrelation coefficients.

18. The method of claim 14, further comprising the steps of:

determining a gain factor for adjusting the energy of said target filtered signal so that an output equalized signal has the same long term energy level as said input signal; and adjusting the gain of said target filtered signal based on said gain factor to provide said output equalized signal.

19. The method of claim 18 wherein said step of determining a gain factor determines the gain factor to be based on a ratio of the long term energy of said input signal and the long term energy of said target filtered signal.

20. In a mobile telephone, an apparatus for encoding a speech signal, comprising:

(A) an acoustic to electrical transducer that receives the speech signal and converts the speech signal to an electrical signal, the acoustic to electrical transducer having a frequency response that is different from an ideal frequency response;

(B) an adaptive equalizer that receives an input signal representative of the electrical signal from the acoustic to electrical transducer, the adaptive equalizer including:

an adaptive whitening filter for receiving said input signal and for filtering said input signal in order to flatten a long term spectral response of said input signal to provide a whitened signal; and a target filter for receiving said whitened signal and for filtering said whitened signal in accordance with a target spectral response to provide a target filtered signal, wherein said target spectral response is for impressing a spectrum that is closer to said ideal frequency response upon said whitened signal;

(C) a speech encoder that encodes the target filtered signal from the adaptive equalizer.

21. The adaptive equalizer of claim 20, further comprising:

an input spectral response element for receiving said input signal and for computing said long term spectral response in accordance with said input signal.

* * * * *